US010290979B2

(12) United States Patent
Pankau et al.

(10) Patent No.: US 10,290,979 B2
(45) Date of Patent: May 14, 2019

(54) ELECTRICAL CONNECTOR ASSEMBLY

(71) Applicant: Aptiv Technologies Limited, St. Michael (BB)

(72) Inventors: Harald Pankau, Furth (DE); Daniel Hackbarth, Munich (DE); Gert Droesbeke, Erkrath (DE); Jean Razafiarivelo, Rambouillet (FR)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 16/037,415

(22) Filed: Jul. 17, 2018

(65) Prior Publication Data

US 2019/0058290 A1 Feb. 21, 2019

(30) Foreign Application Priority Data

Aug. 18, 2017 (EP) ..... 17186930

(51) Int. Cl.

| | |
|---|---|
| ***H01R 12/58*** | (2011.01) |
| ***H01R 43/20*** | (2006.01) |
| ***H01R 12/72*** | (2011.01) |
| ***H01R 13/6585*** | (2011.01) |

(52) U.S. Cl.

CPC ..... *H01R 13/6585* (2013.01); *H01R 12/585* (2013.01); *H01R 12/724* (2013.01); *H01R 43/205* (2013.01)

(58) Field of Classification Search

CPC .. H01R 12/724; H01R 12/585; H01R 43/205; H01R 13/6585

See application file for complete search history.

(56) References Cited

U.S. PATENT DOCUMENTS 4,550,962 A * 11/1985 Czeschka ..... H01R 12/585 29/739
4,846,727 A * 7/1989 Glover ..... H01R 13/6587 439/607.07
4,871,321 A * 10/1989 Johnson ..... H01R 12/727 439/79
5,504,989 A * 4/1996 Clark ..... H01R 43/205 29/33 M (Continued)

FOREIGN PATENT DOCUMENTS

DE 3925958 C1 2/1991
EP 128306 A1 12/1984

(Continued)

*Primary Examiner* — Briggitte R Hammond
(74) *Attorney, Agent, or Firm* — Robert J. Myers

(57) ABSTRACT

A network connector assembly comprises a header housing having two pins forming a pin pair. A first pin end portion can be connected to a counter connector. A second pin end portion can be connected to a PCB. A first electrically conductive shielding member is arranged laterally to the pin pair. A second electrically conductive shielding member is arranged intermediate the pin pair. The second pin end portions form a press fit connector configured to connect to the PCB. The second pin end portions comprise a press protrusion configured to cooperate with a press tool while being pressed in a PCB-opening of the PCB. The second electrically conductive shielding member defines a tool opening arranged at a position that allows movement of a press tool through the tool opening along a tool axis to access the press protrusion.

16 Claims, 5 Drawing Sheets

(56) References Cited

U.S. PATENT DOCUMENTS

| | | | | |
|---|---|---|---|---|
| 6,146,202 | A * | 11/2000 | Ramey | H01R 12/585 439/607.1 |
| 6,719,587 | B2 * | 4/2004 | Droesbeke | H01R 13/6589 439/607.1 |
| 7,722,366 | B2 * | 5/2010 | Yamamoto | H01R 12/58 439/79 |
| 7,806,729 | B2 * | 10/2010 | Nguyen | H01R 13/514 439/607.23 |
| 8,764,488 | B2 * | 7/2014 | Zeng | H01R 13/6585 439/108 |
| 8,951,066 | B2 * | 2/2015 | Glick | H01R 13/426 439/595 |
| 9,692,183 | B2 * | 6/2017 | Phillips | H01R 13/6471 |
| 10,014,605 | B2 * | 7/2018 | Dekoski | H01R 12/724 |
| 10,116,092 | B2 * | 10/2018 | Lord | H01R 12/716 |
| 2002/0048995 | A1 * | 4/2002 | Shindo | H01R 23/688 439/607.07 |
| 2002/0192988 | A1 | 12/2002 | Droesbeke et al. | |
| 2003/0166349 | A1 * | 9/2003 | Huss, Jr. | H01R 43/205 439/79 |
| 2006/0141831 | A1 * | 6/2006 | Hsu | H01R 13/41 439/108 |
| 2006/0281346 | A1 * | 12/2006 | Pan | H01R 12/727 439/79 |
| 2015/0280335 | A1 * | 10/2015 | Sartori | H01R 13/502 439/695 |

FOREIGN PATENT DOCUMENTS

| | | | |
|---|---|---|---|
| EP | 1107400 | A1 | 6/2001 |
| EP | 1263088 | A1 | 12/2002 |
| WO | 2015124482 | A1 | 8/2015 |

* cited by examiner

ELECTRICAL CONNECTOR ASSEMBLY

CROSS-REFERENCE TO RELATED APPLICATION

This application claims the benefit under 35 U.S.C. § 119(a) of Patent Application No. 17186930.8 filed in the European Patent Office on Aug. 18, 2017, the entire disclosure of which is hereby incorporated by reference.

TECHNICAL FIELD OF THE INVENTION

The invention relates to a network connector assembly, in particular for vehicles, wherein the network connector assembly is suitable for networks communicating at data rates of 100 megabits per second (Mbit/s) to 1 gigabits per second (Gb/s).

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
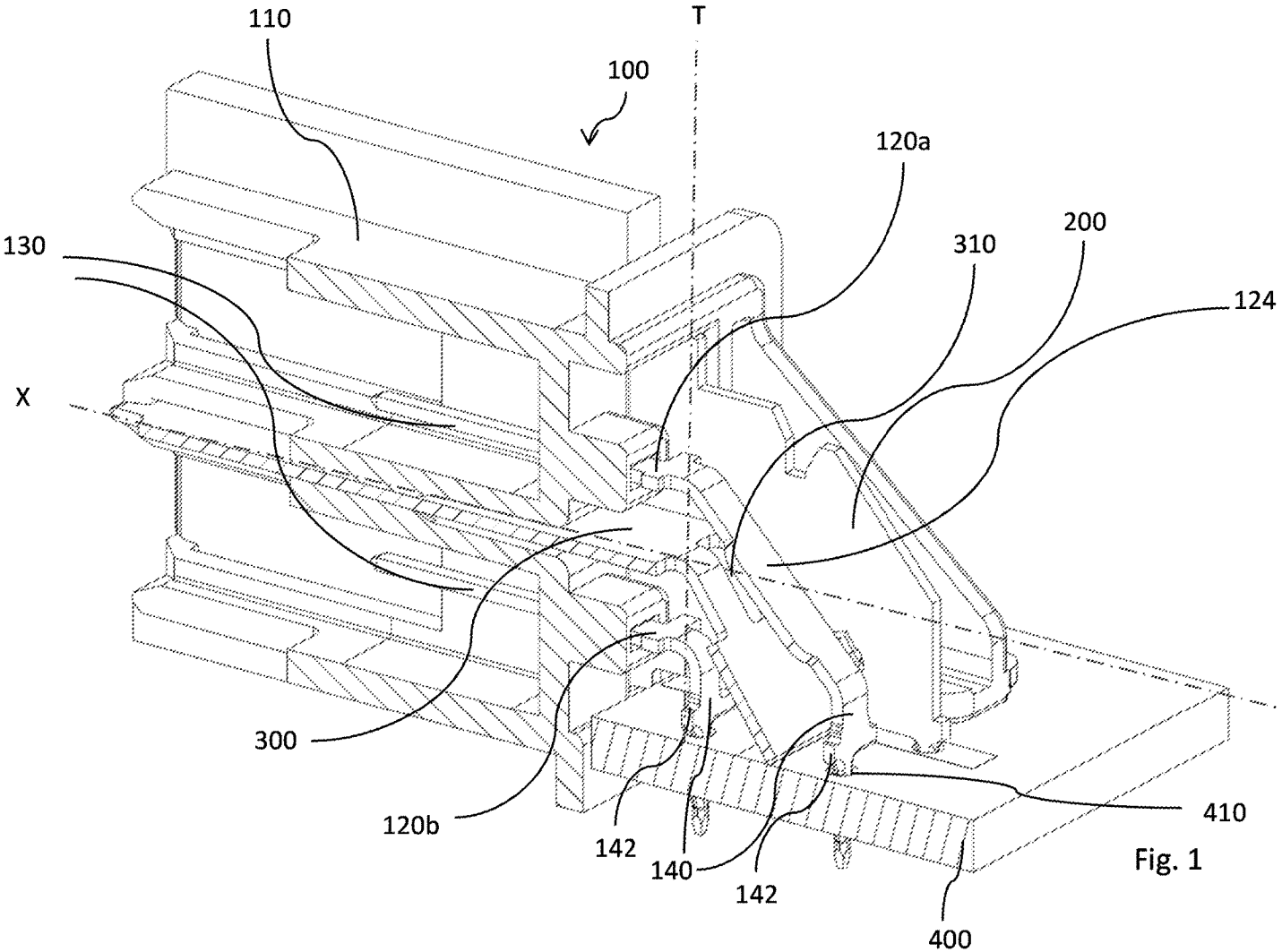
FIG. 1 shows a perspective cross section view of a network connector assembly according to one embodiment of the invention.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

The present application relates to a network connector assembly, in particular for vehicles. The network preferably communicates at data rates of 100 megabits per second (Mbit/s) to 1 gigabits per second (Gb/s) or more. The network connector assembly comprises a header housing having two pins, thereby forming a pin pair. A first pin end portion of each of the pins are configured to be connected to a counter-connector along a mating axis. A second pin end portion of each of the pins is configured to be connected to a printed circuit board (PCB). The second pin end portions extend perpendicularly to the mating axis. A first electrically conductive shielding member is arranged laterally to the pin pair, thereby shielding the pin pair on one side. A second electrically conductive shielding member is arranged in between the pins of the pin pair, thereby shielding the a two pins from each other. The second pin end portions form a press fit connector configured to connect to the PCB. The second pin end portions comprise a press protrusion protruding perpendicularly from the second pin end portions. The press protrusion is configured to cooperate with a press tool while being pressed in a PCB-opening of the PCB. The second electrically conductive shielding member comprises a tool opening, wherein the tool opening is arranged at a position that allows movement of a press tool through the tool opening along a tool axis, to access the press protrusion.

The disclosed invention provides an opportunity to connect the pins of the network connector assembly to the conductive layer of the PCB by using press fit technology. The principle for a press-fit connection is that a contact terminal is pressed into a printed circuit board (PCB). There are two types of press-fit pins; the solid pin having a solid press-in zone and the compliant pin having an elastic press-in zone. The disclosed invention is able to use both types of press-fit pins. While using preassembled shielded network connector assemblies, it is difficult to connect the network connector assembly to the PCB because the press-fit pins are covered in a wide range of the shielding means. A press in tool can't engage the press-fit pins to force them into openings of the PCB. The solution of this problem is to provide openings in the shielding means that allow access to the press-fit pins. But the openings in the shielding means have to be placed carefully to not destroy the shielding ability.

The present application further relates to a method to assemble a network connector assembly to a PCB. The method comprises the steps of:

providing a network connector assembly;

providing a PCB;

providing a tool;

adjusting the network connector assembly on the PCB thereby positioning the second pin end portion over the PCB opening of the PCB;

aligning the tool to the network connector assembly;

pressing the second pin end portion into the PCB opening using the tool; and removing the tool.

While conducting the step of pressing the second pin end portion into the PCB-opening using the tool, either the network connector assembly is moved towards the PCB or the PCB is moved towards the network connector assembly.

According to a preferred embodiment, the second electrically conductive shielding member provides shielding between the two pins of the pin pair along the second electrically conductive shielding member. An imaginary linear line between the pins intersects with the second electrically conductive shielding member and the position of the tool opening is spaced away from this intersection. In other words, one pin is not visible from the other. The tool opening is spaced away from the line of sight of the pins. As long as the pins are not visible to each other the shielding works quite well.

Preferably, the first shielding member comprises a substantially flat first shielding plate that is arranged parallel to the mating axis. The second shielding member has a second shielding plate that is arranged perpendicularly to the first shielding plate. The second shielding member has a substantially flat internal shielding portion that is arranged along the mating axis and a substantially flat external shielding portion, angled with respect to the internal shielding portion.

The first shielding plate and the second shielding plate are arranged perpendicularly to each other forming a T shape in cross-section. The external shielding portion is angled to keep the distance to the angled connector pins thereby providing continues shielding. The first shielding plate in the second shielding plate are usually made from sheet metal but may also be made of electrically conductive plastics.

Advantageously, the substantially planar internal shielding portion is at least partly in intimate contact with the header housing, wherein the external shielding portion protrudes outside the header housing providing flexible movement. The internal shielding portion can be captured in a cavity of the header housing. In another embodiment the internal shielding portion can be fixed inside the header housing while molding the header housing. The external shielding portion is able to cooperate with rigid protrusion by moving flexible when coming in engagement with them. That makes the design of counter contacts easier.

Preferably, the first shielding plate includes a grounding bulge which protrudes from the first shielding plate towards the external shielding portion, wherein the external shielding portion is arranged laterally and in contact with the grounding bulge, thereby electrically connecting the first shielding plate and the second shielding plate. Because no cuts in the first shielding plate are necessary to provide a grounding contact, the first shielding plate keeps a closed surface and provides best shielding performance. The grounding bulge can be pressed into the first shielding plate with a tool. This flexible contact between the grounding bulge and the second shielding plate provides reliable contact over a lifetime of the assembly.

Advantageously, the tool opening is arranged at least partly in an area of the second shielding plate where the internal shielding portion and the external shielding portion are connected. Providing the tool opening in the region where the second shielding plate is bend, makes the bending process easier because on the bending edge is less material.

Preferably, one of the two pins contains an intermediate pin portion arranged between the first pin end portion and the second pin end portion, wherein the intermediate pin portion is straight in shape and connected to the first pin end portion defining an angle less than 90° and connected to the second pin end portion defining an angle less than 90°, wherein the first pin end portion and the second pin end portion of the other of the two pins, are connected defining an angle of 90°. The usage of an intermediate pin portion is necessary to configure the two signal paths of high-speed data transfer to the different geometry of the two pins of the network connector assembly.

Preferably the planar external shielding portion, is angled to extend parallel to the intermediate pin portion In a preferred embodiment, the intermediate pin portion varies in width along the way from the first pin end portion to the second pin end portion. The intermediate pin portion extends parallel to the external shielding portion of the second shielding plate to keep the impedance of the signal path constant.

Advantageously, the network connector assembly is mounted on a printed circuit board (PCB). The first shielding member includes a contacting member for electrically conductive contacting the shielding member with the printed circuit board. The contacting member can also be designed as a press-fit connection. The contacting member can be pressed into the PCB at the same time when the contact pins are pressed in. That makes it possible to connect the network connector assembly in one step to the PCB.

Advantageously, parts of the second pin end portions are received in the PCB opening of the PCB. The parts of the second pin end portions that are received in the PCB openings make contact to conductive sleeves arranged inside the PCB-openings.

Preferably, the second electrically conductive shielding member is insulated from the PCB and electrically connected only to the first shielding member. The second electrically conductive shielding member does not need an electrical connection to the PCB. That saves space on the PCB where usually contact points for connecting the shielding are required.

Preferably, the network connector assembly includes a third electrically conductive shielding member that is arranged laterally to the pin pair and opposite to the first electrically conductive shielding member, thereby shielding the pin pair on the other side. Additional shielding members improve the robustness of the data transfer while using high data rates. The pin pairs are surrounded on a high amount of shielding members that prevent interferences with other pin pairs.

Advantageously, the third shielding member has a grounding bulge protruding from the third shielding member towards the external shielding portion, wherein the external shielding portion is arranged laterally and in contact with the grounding bulge, thereby electrically connecting the third shielding member and the second shielding plate. As described for the first shielding plate, the grounding bulge can be pressed into the third shielding member with a tool. This design needs only one grounding point between shielding member and the PCB to provide a complete shielding of the network connector assembly.

Additional embodiments of the network connector assembly may be envisioned wherein the first shielding plate provides a grounding bulge that engages with the external shielding portion to keep it in place. This has the advantage that improved shielding continuity between the horizontal shield and the vertical shield is provided in an easy to manufacture manner. As the vertical shield comprises for example bulges or embossments that are easy to create, there is no need for complicated stamping tools or attachment means between the external shielding portion and the first shielding plate. Moreover, as the external shielding portion is bended, a pre-spring force in the external shielding portion may be used to abut to the grounding bulge to provide an efficient shielding continuity in an easy to manufacture manner.

A network connector assembly particularly suited for use in vehicles as part of a data transmission network that communicates at data rates of 100 Mb/s to 1 Gb/s or more is described herein. The network connector assembly comprises a header housing and a first electrically conductive shielding member, arranged laterally to a second electrically conductive shielding member. The first shielding member comprises a substantially flat first shielding plate, arranged parallel to a mating axis of the connector assembly. The second shielding member comprises a second shielding plate, arranged perpendicularly to the first shielding plate, having a substantially flat internal shielding portion, arranged along the mating axis and a substantially planar external shielding portion, angled with respect to the internal shielding portion. The substantially planar internal shielding portion is at least partly in intimate contact with the header housing. The external shielding portion protrudes outside the header housing providing flexible movement. The first shielding plate comprises a grounding bulge protruding from the first shielding plate towards the external shielding portion. The external shielding portion is arranged laterally and in contact with the grounding bulge, connecting the first shielding plate and the second shielding plate electrically.

FIG. 1 shows a perspective, view of a network connector assembly 100, The network connector assembly 100 comprises a header housing 110, comprising two pins 120*a*, 120*b*, forming a pin pair 122. A first pin end portion 130 of each of the two pins 120*a*, 120*b* are configured to be connected to a counter connector along a mating axis X. A second pin end portion 140 of each of the two pins 120*a*, 120*b* is configured to be connected to a printed circuit board (PCB) 400. The second pin end portions 140 extend perpendicularly to the mating axis X. The second pin end portions 140 comprise a press protrusion 142, protruding perpendicularly from the second pin end portions 140, configured to cooperate with a press tool 500, while being pressed in a PCB-opening 410 of the PCB 400. A first electrically conductive shielding member 200, hereinafter referred to as the first shielding member 200 is arranged laterally to the pin pair 122, shielding the pin pair 122 on a side. A second electrically conductive shielding member 300, hereinafter referred to as the second shielding member 300, is arranged in between the two pins 120*a*, 120*b* of the pin pair 122, shielding the two pins 120*a*, 120*b* from each other. The second shielding member 300 is insulated from the PCB 400 and electrically connected only to the first shielding member 200. The second shielding member 300 comprises a tool opening 310. The tool opening 310 is arranged at a position that allows movement of a press tool 500 (see FIG. 5) through the tool opening 310 along a tool axis T, to access the press protrusion 142. The second pin end portions 140 form a press fit connector configured to connect to the PCB 400.

Figure 2:
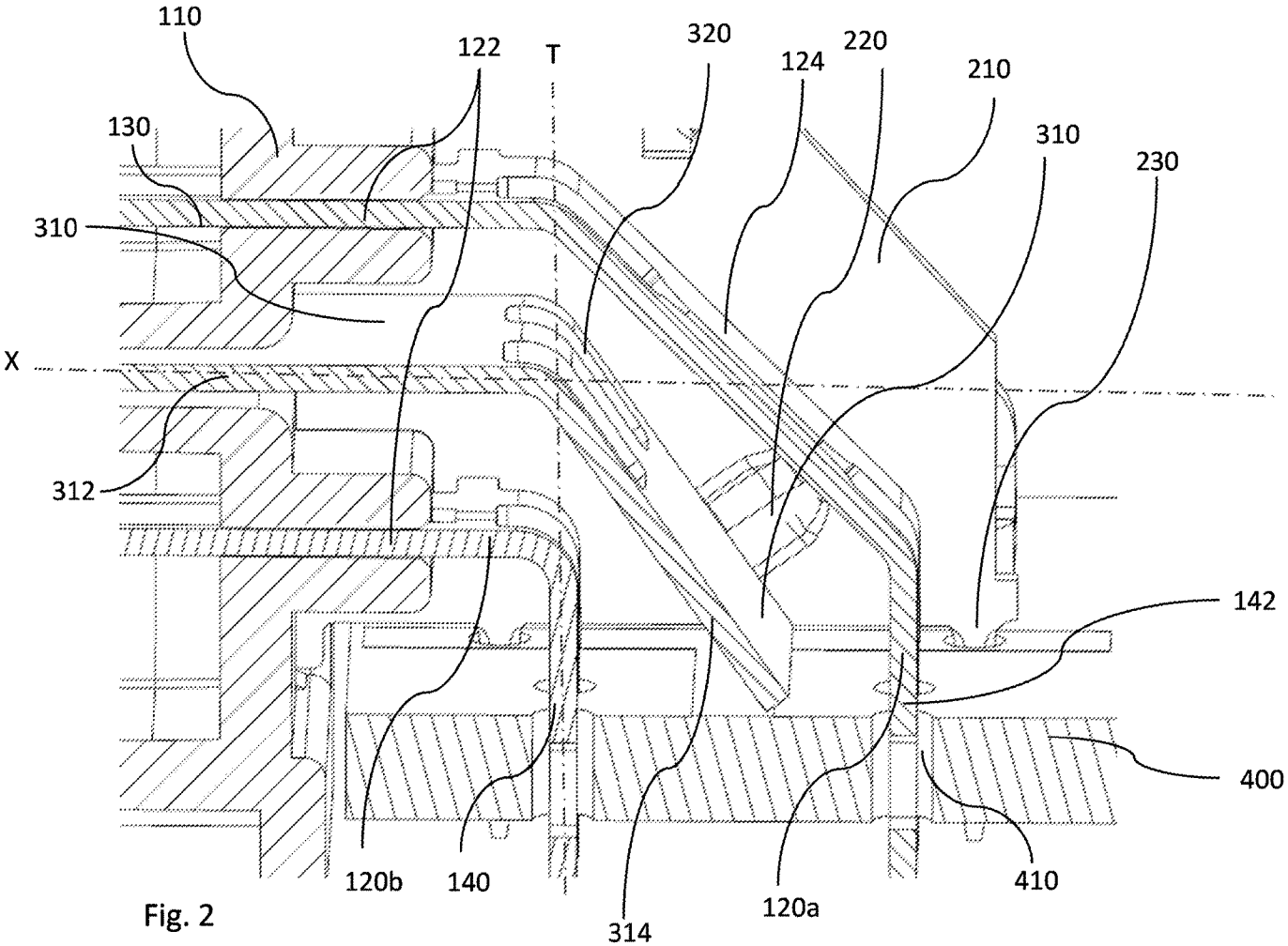
FIG. 2 shows a partial cross section side view of the network connector assembly of FIG. 1 according to one embodiment of the invention.

FIG. 2 shows a perspective, side view of a network connector assembly 100. The second shielding member 300 provides shielding between the two pins 120*a*, 120*b* of the pin pair 230 along the second shielding member 300. The second shielding member 300 provides a continuous line of shielding material between the two pins 120*a*, 120*b*. The tool opening 310 is spaced away from the continuous line. The first shielding member 200 comprises a substantially flat first shielding plate 210, arranged parallel to the mating axis X. The second shielding member 300 comprises a second shielding plate 320, arranged perpendicularly to the first shielding plate 210, having a substantially flat, or planar, internal shielding portion 312, arranged along the mating axis X and a substantially flat, or planar, external shielding portion 314, angled with respect to the internal shielding portion 312. Although for cost reasons not a feature of the preferred embodiment, the second shielding member 300 could also have a third substantially flat external shielding portion 314 along the tool axis T. In which case the second shielding member 300 could have his own end portions for connection with a PCB-opening 410 of the PCB 400. The substantially flat or planar internal shielding portion 312 is at least partly in intimate contact with the header housing 110 and wherein the external shielding portion 314 protrudes outside the header housing 110 providing flexible movement. One of the two pins 120*a*, 120*b* comprises an intermediate pin portion 124 arranged between the first pin end portion 130 and the second pin end portion 140, wherein the intermediate pin portion 124 is straight in shape and connected to the first pin end portion 130 defining an angle less than 90° and connected to the second pin end portion 140 defining an angle less than 90°. Although for manufacturability not a feature of the preferred embodiment, the first and second pin end portions 130, 140 could also be linked with a single radius (quarter of a circle). The first pin end portion 130 and the second pin end portion 140 of the other of the two pins 120*a*, 120*b*, are connected defining an angle of 90°. The external shielding portion 314, is angled to extend parallel to the intermediate pin portion 124.

Figure 3:
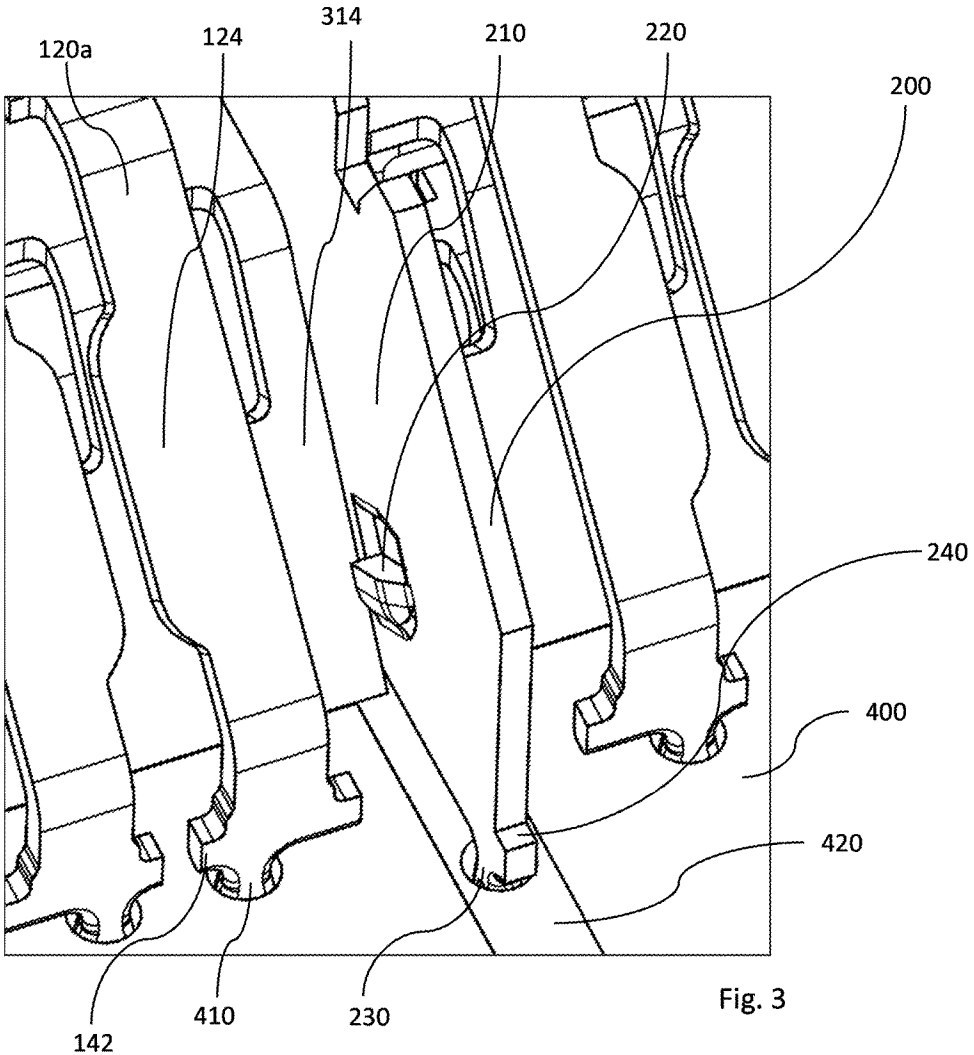
FIG. 3 shows a perspective view to the intermediate pin portion of the network connector assembly of FIG. 1 according to one embodiment of the invention.

FIG. 3 shows a perspective, view to the intermediate pin portion 124 of a network connector assembly 100. The first shielding plate 210 comprises a grounding bulge 220 protruding from the first shielding plate 210 towards the external shielding portion 314 and wherein the external shielding portion 314 is arranged laterally and in contact with the grounding bulge 220, connecting the first shielding plate 210 and the second shielding plate 320 electrically. The tool opening 310 is arranged at least partly in an area of the second shielding plate 320 where the internal shielding portion 312 and the external shielding portion 314 are connected. The intermediate pin portion 124 varies in width along the way from the first pin end portion 130 to the second pin end portion 140 to enable the press tool 500 to access the press protrusion 412. The network connector assembly 100 is mounted on a printed circuit board (PCB) 400. The first shielding member 200 comprises a contacting member 230 for electrically conductive contacting the first shielding member 200 with conductive traces 420 on the PCB 400. The first shielding member 200 comprises also a ground press protrusion 240 to for pressing the contacting member 230 into an opening of the PCB 400. Parts of the second pin end portions 140 are received in the PCB-opening 410 of the PCB 400.

Figure 4:
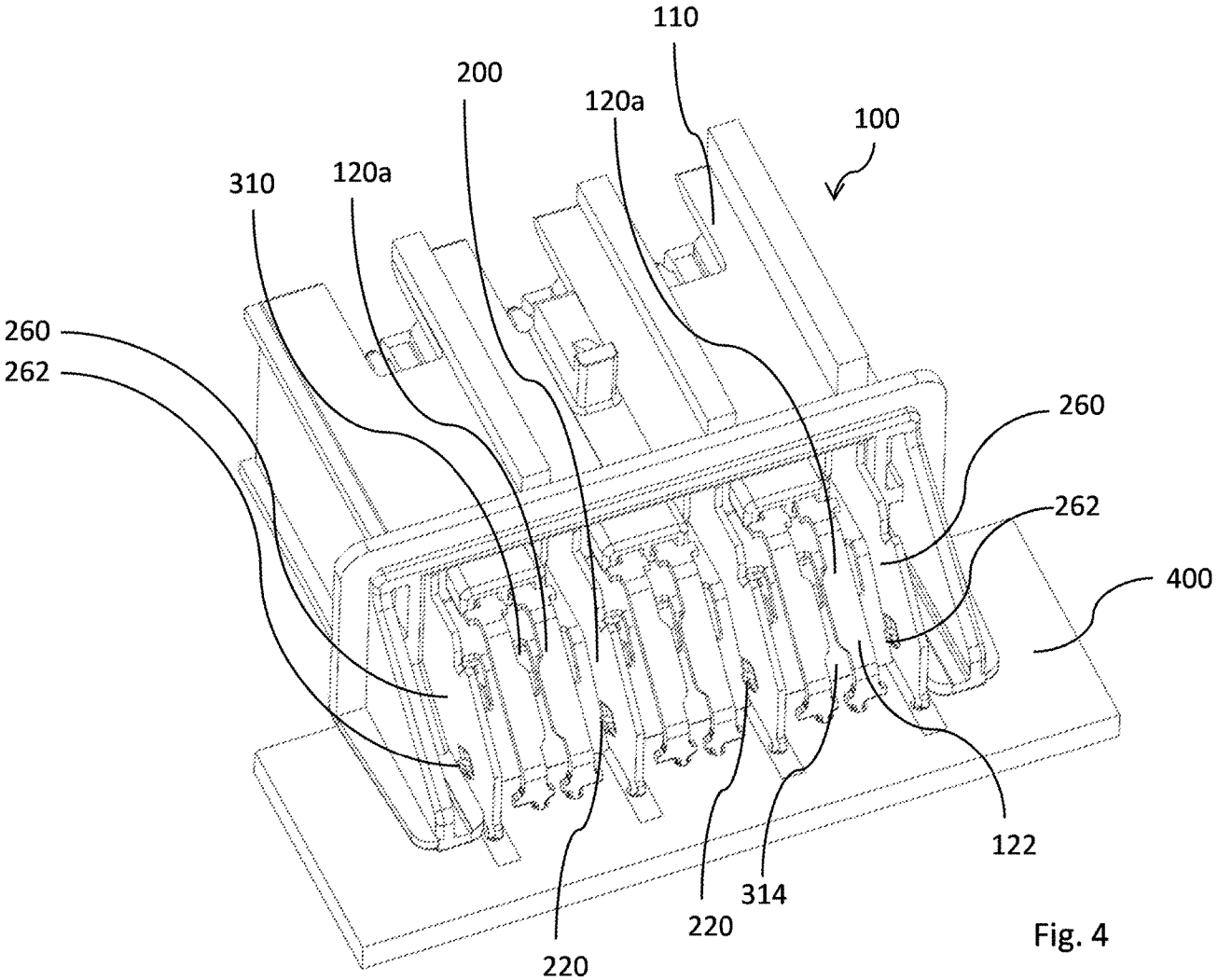
FIG. 4 shows a perspective view of details of the intermediate pin portion, the first electrically conductive shielding member and the printed circuit board of the network connector assembly of FIG. 1 according to one embodiment of the invention.

FIG. 4 shows a perspective, view of a network connector assembly 100 with six pin pairs 122 in a row. Only one row of the pins 120*a*, 120*a*, is visible because the other pins, 120*b*, are covered by the external shielding portion 314. A first shielding member 200 is arranged between two pins 120*a*, 120*b*. On the ends of the row, third electrically conductive shielding members 260, hereinafter referred to as third shielding members 260, are arranged laterally to the pin pairs 122 and opposite to the first shielding members 200, thereby shielding the pin pairs 122 on the other sides. The third shielding member 260 comprises a grounding bulge 262 protruding from third shielding member 260 towards the external shielding portion 314 and wherein the external shielding portion 314 is arranged laterally and in contact with the grounding bulge 262, connecting the third shielding member 260 and the second shielding plate 320 electrically.

Figure 5:
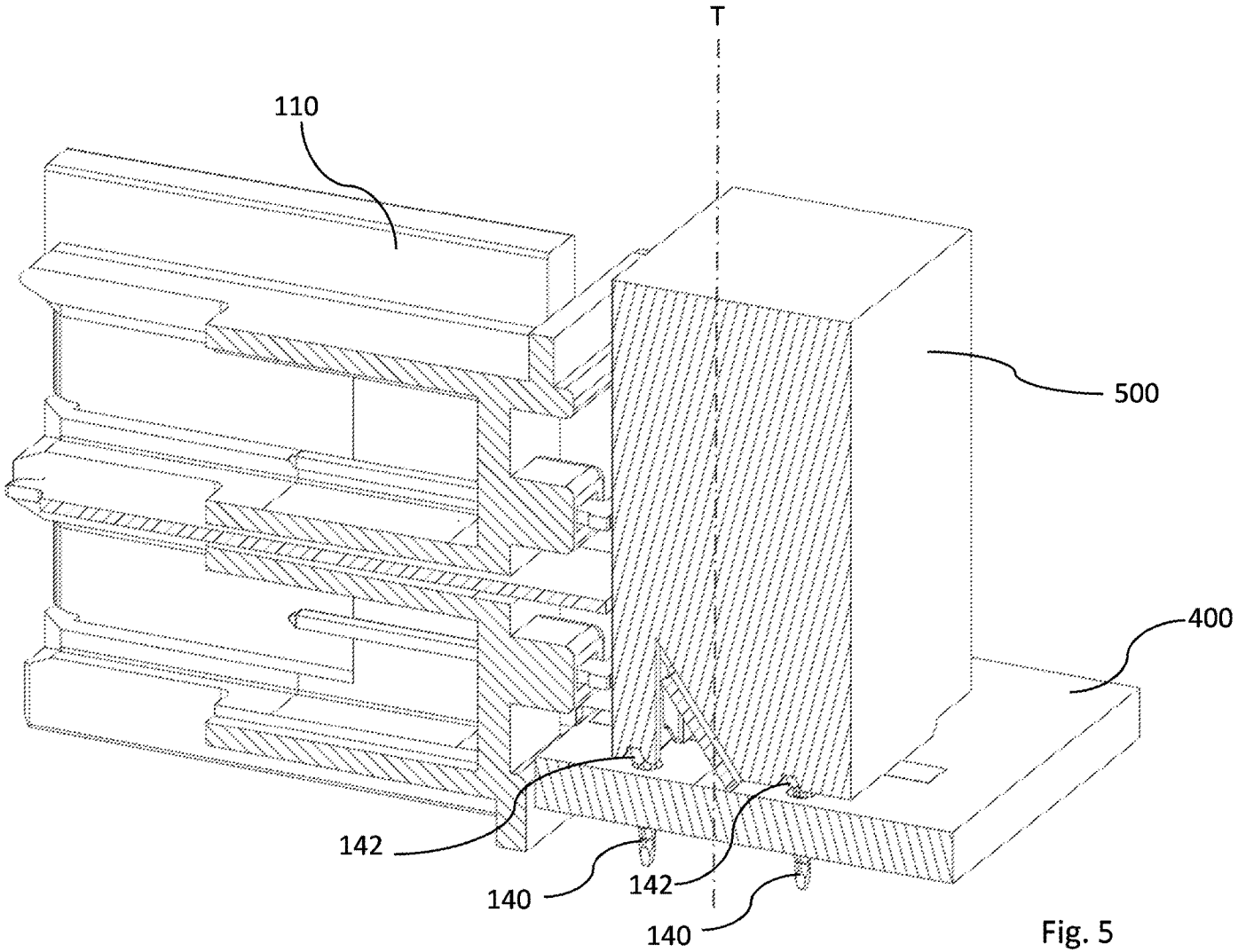
FIG. 5 shows a perspective view of the network connector assembly of FIG. 1 with a press tool according to one embodiment of the invention.

FIG. 5 shows a perspective, view of network connector assembly 100 with the press tool 500. The press tool 500 is at the end of the motion towards the PCB 400. Parts of the second end portions 140 protrude through the PCB-openings 410. Contact means (not shown) inside the PCB-opening 410 contact the second end portions 140 with the conductive traces on the PCB 400.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. Moreover, the use of the terms first, second, etc. does not denote any order of importance, but rather the terms first, second, etc. are used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, directional terms such as upper, lower, etc. do not denote any particular orientation, but rather the terms upper, lower, etc. are used to distinguish one element from another and establish a relationship between the various elements.

We claim:

1. A network connector assembly, comprising:

a header housing having two pins forming a pin pair, wherein a first pin end portion of each of the two pins are configured to be connected to a counter-connector along a mating axis, wherein a second pin end portion of each of the two pins is configured to be connected to a printed circuit board (PCB), and wherein the second pin end portions extend perpendicularly to the mating axis;

a first electrically conductive shielding member arranged laterally to the pin pair, thereby shielding the pin pair on one side; and a second electrically conductive shielding member arranged intermediate the two pins, thereby shielding the two pins from each other, wherein the second pin end portions form a press fit connector configured to connect to the printed circuit board, wherein the second pin end portions comprise a press protrusion, protruding perpendicularly from the second pin end portions configured to cooperate with a press tool while being pressed in a PCB-opening of the printed circuit board, wherein the second electrically conductive shielding member comprises a tool opening, and wherein the tool opening is arranged at a position that allows movement of the press tool through the tool opening along a tool axis to access the press protrusion.

2. The network connector assembly according to claim 1, wherein the second electrically conductive shielding member provides shielding between the two pins along the second electrically conductive shielding member.

3. The network connector assembly according to claim 1, wherein the first shielding member defines a substantially flat first shielding plate arranged parallel to the mating axis and wherein the second shielding member comprises a second shielding plate, arranged perpendicularly to the first shielding plate having a substantially planar internal shielding portion arranged along the mating axis and a substantially planar external shielding portion angled with respect to the internal shielding portion.

4. The network connector assembly according to claim 3, wherein the substantially planar internal shielding portion is at least partly in intimate contact with the header housing and wherein the external shielding portion protrudes outside the header housing providing flexible movement.

5. The network connector assembly according to claim 3, wherein the first shielding plate comprises a grounding bulge protruding from the first shielding plate towards the external shielding portion and wherein the external shielding portion is arranged laterally and in contact with the grounding bulge, connecting the first shielding plate and the second shielding plate electrically.

6. The network connector assembly according to claim 3, wherein the tool opening is arranged at least partly in an area of the second shielding plate where the internal shielding portion and the external shielding portion are connected.

7. The network connector assembly according to claim 3, wherein one of the two pins comprises an intermediate pin portion arranged between the first pin end portion and the second pin end portion, wherein the intermediate pin portion is straight in shape and connected to the first pin end portion defining an angle less than 90° and connected to the second pin end portion defining an angle less than 90°, and wherein the first pin end portion and the second pin end portion of the other of the two pins are connected defining an angle of 90°.

8. The network connector assembly according to claim 7, wherein the external shielding portion is angled to extend parallel to the intermediate pin portion.

9. The network connector assembly according to claim 7, wherein the intermediate pin portion varies in width between the first pin end portion to the second pin end portion.

10. The network connector assembly according to claim 1, wherein the network connector assembly is mounted on the printed circuit board and wherein the first shielding member comprises a contacting member for electrically conductive contacting the first electrically conductive shielding member with the printed circuit board.

11. The network connector assembly according to claim 1, wherein parts of the second pin end portions are received in the PCB-opening of the printed circuit board.

12. The network connector assembly according to claim 1, wherein the second electrically conductive shielding member is insulated from the printed circuit board and electrically connected only to the first shielding member.

13. The network connector assembly according to claim 1, further comprising a third electrically conductive shielding member arranged laterally to the pin pair opposite the first electrically conductive shielding member, thereby shielding the pin pair on the other side.

14. The network connector assembly according to claim 13, wherein the third shielding member defines a grounding bulge protruding from the third shielding member towards the external shielding portion and wherein the external shielding portion is arranged laterally and in contact with the grounding bulge, thereby electrically connecting the third shielding member and the second shielding plate.

15. A network connector assembly, comprising a header housing;

a first electrically conductive shielding member; and a second electrically conductive shielding member arranged laterally to the first electrically conductive shielding member, wherein the first shielding member comprises a substantially flat first shielding plate arranged parallel to a mating axis of the network connector assembly, wherein the second shielding member comprises a second shielding plate arranged perpendicularly to the first shielding plate, said first shielding plate having a substantially planar internal shielding portion arranged along the mating axis and a substantially planar external shielding portion angled with respect to the internal shielding portion, wherein the substantially planar internal shielding portion is at least partly in intimate contact with the header housing, wherein the external shielding portion protrudes outside the header housing providing flexible movement, wherein the first shielding plate comprises a grounding bulge protruding from the first shielding plate towards the external shielding portion, and wherein the external shielding portion is arranged laterally and in contact with the grounding bulge, thereby electrically connecting the first shielding plate and the second shielding plate.

16. A method to assemble a network connector assembly to a printed circuit board (PCB), comprising the steps of:

providing the network connector assembly, said network connector assembly comprising a header housing having two pins forming a pin pair, wherein a first pin end portion of each of the two pins are configured to be connected to a counter-connector along a mating axis, wherein a second pin end portion of each of the two pins is configured to be connected to a printed circuit board (PCB), wherein the second pin end portions extend perpendicularly to the mating axis, said network connector assembly further comprising a first electrically conductive shielding member arranged laterally to the pin pair, thereby shielding the pin pair on one side, and said network connector assembly also comprising a second electrically conductive shielding member arranged in between the two pins of the pin pair, thereby shielding the two pins from each other, wherein the second pin end portions form a press fit connector configured to connect to the printed circuit board, wherein the second pin end portions comprise a press protrusion, protruding perpendicularly from the second pin end portions configured to cooperate with a press tool while being pressed in a PCB-opening of the printed circuit board, wherein the second electrically conductive shielding member comprises a tool opening, and wherein the tool opening is arranged at a position that allows movement of the press tool through the tool opening along a tool axis to access the press protrusion;

providing the printed circuit board;

providing the press tool;

adjusting the network connector assembly on the printed circuit board, thereby positioning the second pin end portion over the PCB-opening of the printed circuit board;

aligning the press tool on the network connector assembly;

pressing the second pin end portion into the PCB-opening using the press tool; and removing the press tool.

* * * * *